US006151278A

United States Patent [19]

Najarian

[11] Patent Number: 6,151,278

[45] Date of Patent: Nov. 21, 2000

[54] REMOTE DEVICE FOR SILENT AWAKENING

[75] Inventor: David Najarian, Randolph, N.J.

[73] Assignee: D. Najarian, Randolph, N.J.

[21] Appl. No.: 09/090,269

[22] Filed: Jun. 3, 1998

[51] Int. Cl.[7] ..... G04B 47/00

[52] U.S. Cl. ..... 368/12; 368/230; 368/261

[58] Field of Search ..... 368/12, 230, 47, 368/250, 10, 72–74

[56] References Cited

U.S. PATENT DOCUMENTS

| | | | |
|---|---|---|---|
| 4,144,706 | 3/1979 | Willis | 368/12 |
| 4,316,273 | 2/1982 | Jetter | 368/47 |
| 5,442,600 | 8/1995 | kutosky | 368/109 |
| 5,497,141 | 5/1996 | Coles et al. | 368/12 |
| 5,686,882 | 11/1997 | giani | 368/12 |
| 5,696,497 | 12/1997 | mottier et al. | 368/47 |
| 5,737,692 | 4/1998 | lang | 368/250 |
| 5,764,594 | 6/1998 | berman et al. | 368/12 |
| 5,894,455 | 4/1999 | sikes | 368/12 |

*Primary Examiner*—Bernard Roskoski
*Attorney, Agent, or Firm*—Gibbons, Del Deo, Dolan, Griffinger & Vecchione

[57] ABSTRACT

An improved programmable and remote-controlled device for awakening a user through the user's sense of touch is disclosed. The device utilizes a time keeping alarm circuit to accurately track and display time and also to output an alarm signal at a user-defined preset alarm time. The alarm signal is modulated, amplified, encrypted, and transmitted to a receiving unit. The receiving unit is strapped to or otherwise held against the user's body. The receiving unit decodes the received encrypted alarm signal and activates a vibrating mechanism utilized to awaken the user via the vibrating mechanism without relying upon an audible alarm.

20 Claims, 5 Drawing Sheets

ALARM CLOCK CIRCUIT
LED DISPLAY
POWER SOURCE
BATT MONITOR
VIBRAT. MECH.
Q1 DECODE
RE-CEIVER
Q2 DECODE
XMITTER
ENCODER
DELAYED TIMER
AUDIBLE TONE
RADIO
A/S
MS M/V
5P2T
5P3Ta
5P3Tb
5P2Tb
1P2T
300
302
304
306
308
310
312
314
316
318
320
322
324
330
340
345
350-1
350-2
351
352
353
354
355
356
357
358
360-1
360-2
362-1
362-2
Q1
Q2
D1
D2
D3
D4
D5
D6
D7
D8
D10
D11
D12
D13
i1
i2

REMOTE DEVICE FOR SILENT AWAKENING

FIELD OF THE INVENTION

This invention relates to the field of clock radios and other awakening devices.

BACKGROUND OF THE INVENTION

Traditional clock radios display time information, receive radio frequency (RF) signals for FM and AM radio use, and contain an audible radio or buzzer alarm for alerting the user at preprogrammed and predetermined times. More advanced clock radio devices incorporate computers, televisions, compact disk players, audio cassette players, and sleep and snooze alarm features and functions.

While useful in many respects, traditional clock radios are unsuitable for many users because they rely solely upon an audible alarm to alert the user. For example, a conventional audible alarm incorporated within a clock radio device is of little or no value to those users who happen to be hearing impaired or completely deaf. Moreover, while audible alarms may be perfectly capable of alerting the primary user at the desired alarm time, they can also be obtrusive and annoying to others who may be asleep in a common or proximate berthing area and desire to awaken at a later time than the primary user. In such situations, the primary user wishes to ensure that the alarm volume is sufficient to awaken himself at the predetermined time, but often an alarm volume sufficient for that purpose also disturbs others who happen to be asleep in the common or proximate berthing area.

Alternative designs for silent awakening devices have previously been contemplated. For example, U.S. Pat. No. 4,093,944 to Muncheryan (hereinafter 'Muncheryan') describes the design for a clock that can transmit an RF signal to a "pocket pager" unit that contains a vibrating mechanism. While undoubtedly useful, the device described in Muncheryan does not address the possibility that the "pocket pager" may fail to receive the RF alarm signal and therefore fail to wake the user. All antennas display directivity and gain characteristics, so RF transmissions are relatively weak in certain directions with respect to the transmitting antenna. Reception quality therefore depends upon the location of the receiving antenna with respect to the transmitting antenna associated with the clock. Reception of RF transmissions is also relatively weak when the polarization of the receiving antenna differs from the polarization of the transmitting antenna. Therefore, reception quality also depends upon the orientation of the receiving antenna with respect to the transmitting antenna. Destructive interference is another phenomenon which threatens the reception capability of the receiving unit. Radio waves may take different paths to arrive at the receiving unit. If the waves are out of phase when they arrive, the alarm signal will be destroyed. The receiving unit will also fail when its power source is depleted. Conventional battery indicator lights are helpful in alerting users when a degraded power source condition exists and prompting them to replace or charge the receiving unit battery, however, users may fail to identify or inadvertently ignore the warning if the warning is received when the user is tired or asleep. Failure to alarm at a predetermined time, whatever the mode for the failure, is a "false negative" alarm failure.

Further, prior art silent awakening devices do not address the problem of "false positive" alarms. A false positive alarm occurs when the silent awakening unit vibrates (silently alarms) at a time other then the desired preset alarm time. Prior art devices utilize pulsed RF transmission to activate a vibrating mechanism in the receiving unit; therefore, the reliability of the receiving units are susceptible to external sources of electromagnetic radiation. Thus, local broadcasts or noise at the same frequency could activate the vibrating mechanism in the receiving unit.

Many prior art alarm clock radios provide the user with a "snooze function." When the desired preset alarm time is reached and the audible alarm is activated, the user has the option of depressing the "snooze bar." Depressing the snooze bar silences the audible alarm for a predetermined time interval. At the end of the predetermined time interval the audible alarm resumes. Unfortunately, activation of the snooze function requires the user to awaken to silence the alarm by depressing the snooze bar. If the user is not located directly next to the clock radio, he must also arise from the bed in which he is sleeping to depress the snooze bar.

An invention relating to silent alarms is also described in U.S. Pat. No. 5,572,196 to Sakumoto et al. (hereinafter 'Sakumoto'). Sakumoto discloses a device for an electronic analog timepiece equipped with a pager. Similar designs for portable timepieces containing a vibrating alarm but no paging apparatus have been proposed in U.K. Patent No. 2,205,665 to Dines, U.S. Pat. No. 5,089,998 to Rund, U.S. Pat. No. 4,456,387 to Igarashi, U.S. Pat. No. 5,023,853 to Kawata et al., U.S. Pat. No. 5,365,497 to Born, U.S. Pat. No. 5,400,301 to Rackley, U.S. Pat. No. 5,559,761 to Frenkel et al. Each of the above references disclose non-acoustical, vibrating alarm devices incorporated within a timepiece either worn on the user's wrist, placed within the user's pocket, or attached to the user's belt.

While certainly useful, each of the devices disclosed are subject to inherent disadvantages. First, conventional timepiece design requires the user to look at the machine's case and handle small knobs and buttons in order to set the proper alarm time. A watch display is necessarily small and frequently difficult to read. The small knobs and buttons provided as the user control interface on watches are also typically small and difficult to manipulate. Increasing the size of the timepiece case helps people read and handle the device, but only at the expense of obtrusiveness to the user. A person using a large vibrating alarm/timepiece in bed for waking oneself may find that the object's large size inhibits sleep.

SUMMARY OF THE INVENTION

The present invention is a programmable and remote-controlled device for awakening a user through the user's sense of touch. The device utilizes a time keeping alarm circuit to accurately track and display time and also to output an alarm signal at a user-defined preset alarm time. The alarm signal is modulated, amplified, encrypted, and transmitted to a receiving unit. The receiving unit is strapped to or otherwise held against the user's body. The receiving unit decodes the received encrypted alarm signal and activates a vibrating mechanism utilized to awaken the user via the vibrating unit without relying upon an audible alarm.

Advantageously, false positive alarms associated with prior art devices are minimized or eliminated in the present invention. Since the present invention transmits an encoded alarm signal to the receiving unit, the receiving unit decodes the encoded alarm signal to activate the vibrating mechanism. Utilization of encryption at the transmitter and decryption at the receiver prevents false positive alarms which would otherwise result from intentional or unintentional exogenous transmissions at the same frequency.

Additionally, the present invention incorporates time display and control interface functions within the larger clock/transmitter device. The control interface components of clocks, including buttons and LED displays, are much larger than similar devices on portable timepieces (such as wrist worn devices). Because of the larger size of the control interface components, displays are easier to see and controls are easier to manipulate.

The present invention also derives advantage from the exclusion of a timepiece in the receiving unit. For example, the receiving unit need not be constructed large enough for the user to easily read and set the time. Hence its design is focused on remaining small, inconspicuous, and unobtrusive to the user. These qualities are especially important for a user who chooses to take the device to bed for the purpose of waking oneself. By combining the large programmable user interface of a clock with a tiny, inconspicuous receiving unit, the proposed invention offers convenience superior to that offered by alternative designs.

One embodiment of the present invention includes a feature wherein an audible back-up alarm is automatically activated after a predetermined delay period to provide a back-up awakening function should the vibrating unit fail to awaken the user (either because the receiving unit failed to process the transmitted signal or because the user failed to awaken despite proper operation and activation of the vibrating unit). The audible back-up alarm feature is utilized to overcome the limitations associated with prior art false negative alarms.

Another embodiment of the present invention includes a cyclical alarm interrupt function. The cyclical alarm interrupt function of the present invention may be used in conjunction with, or in lieu of, the traditional snooze function and overcomes the disadvantages associated with the traditional snooze function. At the desired preset alarm time, the alarm is activated. If the cyclical alarm interrupt function is selected, then the alarm sequentially activates and deactivates in a cyclical manner. The user may preset the duty cycle (the ratio of alarm time to silent time) prior to going to sleep. The cyclical alarm interrupt function is useful and advantageous because it allows a tired user who wishes to sleep past the preset alarm time the ability to do so without having to manually activate a traditional snooze function.

BRIEF DESCRIPTION OF THE DRAWINGS

A more complete understanding of the present invention may be obtained from consideration of the following description in conjunction with the drawings in which.

DETAILED DESCRIPTION

Figure 1:
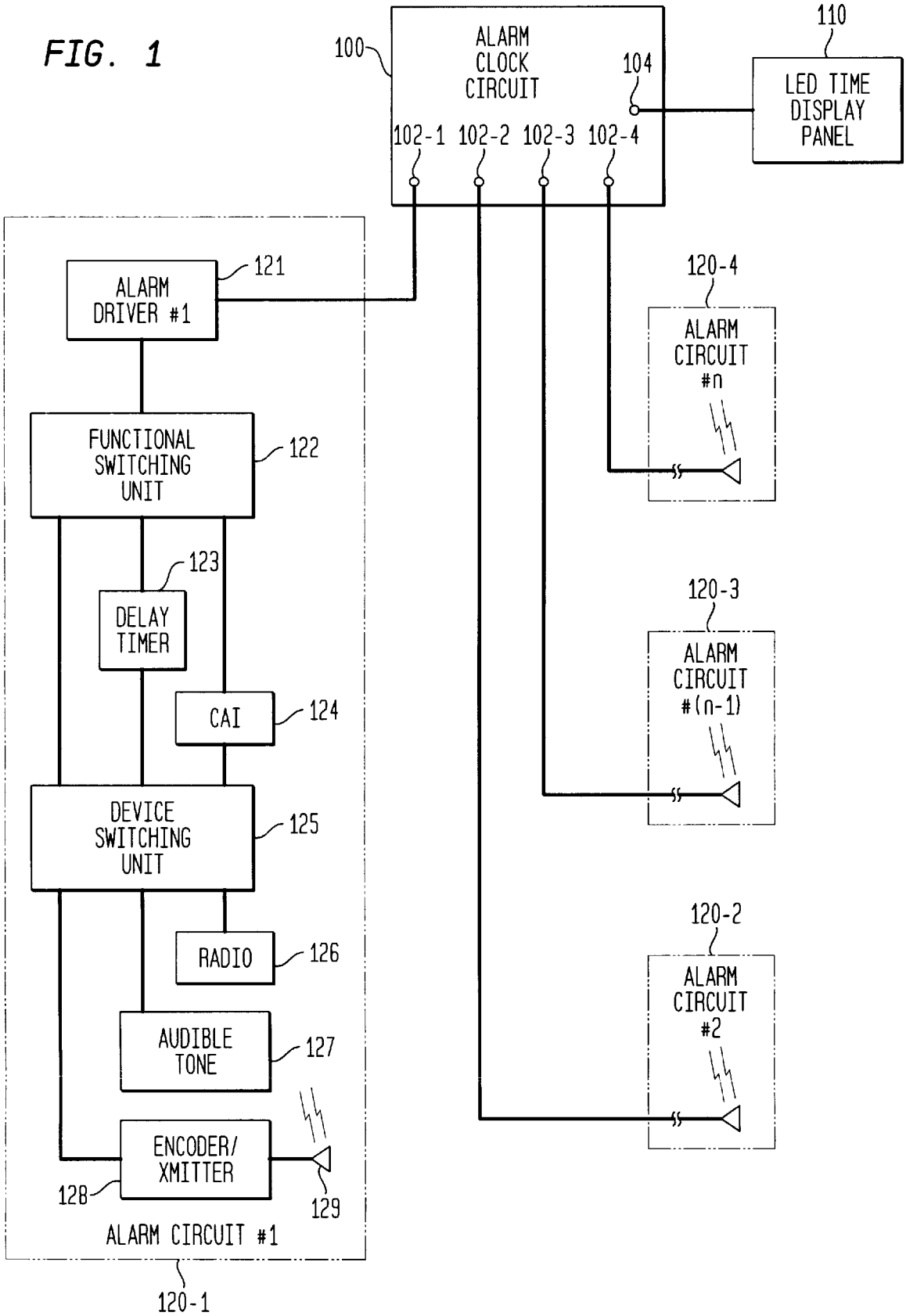
FIG. 1 is a functional block diagram of an alarm clock in accordance with the present invention including a plurality of alarm transmitting circuits in accordance therewith.
Figure 2:
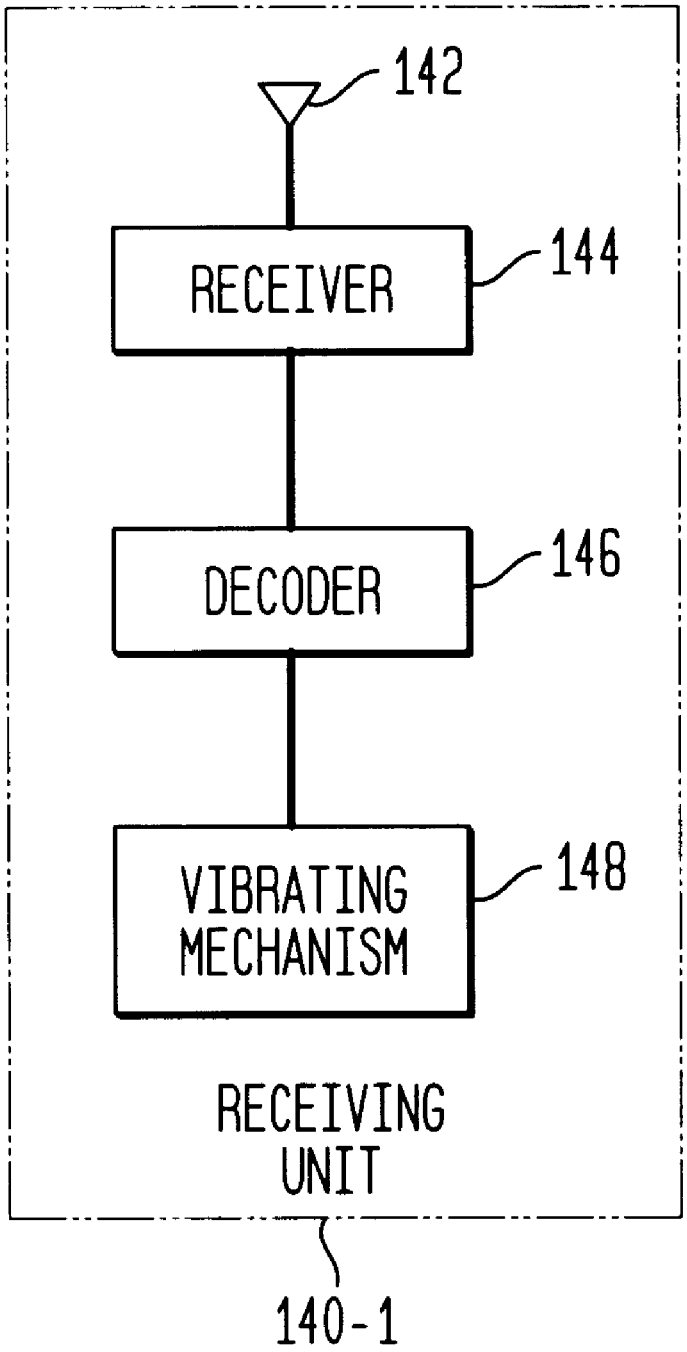
FIG. 2 is a functional block diagram of a remote receiving/vibrating unit incorporated within and in accordance with the present invention.

FIGS. 1 and 2 are functional block diagrams of the present invention. The timekeeping and alarm functions of the present invention are controlled and managed by a conventional and commercially available integrated alarm. clock circuit 100. Users interface the alarm clock programmable features to set clock display time and alarm times via controls located at the clock cabinet. The alarm clock circuit 100 provides digital time data from outlet port 104 to provide time and alarm display at a display panel 110. The alarm clock circuit further provides an alarm signal from an alarm signal output 102 to at least one alarm circuit 120. The embodiment of the present invention illustrated in FIG. 1 shows a plurality of individual alarm signal outputs 102-1 through 102-4 available to supply alarm signals to a corresponding plurality of alarm circuits 120-1 through 120-4 (corresponding to alarm circuit #1 through alarm circuit #n). Providing a plurality of individual alarm circuits 120-1 through 120-4 enables one base unit alarm clock circuit 100 to provide awakening functions (silent or audible) for a corresponding plurality of users.

Each alarm circuit is comprised of an alarm driver 121 which accepts an alarm signal from the corresponding individual alarm signal output 102 from the alarm clock circuit 100. The amplified output of the alarm driver 121 is routed via a functional switching unit 122 to a preselected alarm function option. The instant embodiment of the present invention, in accordance with FIG. 1, illustrates the following user defined alarm function options: (i) a delay timer 123 which provides an audible back-up alarm after a preset time delay has expired from an initial alarm signal, (ii) a cyclical alarm interrupt (CAI) 124 which provides a cyclical alarm state (repetitively on and off) with a preset user selected duty cycle determining the length of time for each alarm period and also the length of time for each subsequent non-alarming period, and (iii) a shunt of both of the aforementioned delay timer 123 and CAI 124.

A device switching unit 125 is provided to select the primary and back-up wake-up mode devices. Typically, the encoder/transmitter 128 is selected as the primary wake-up device since use of the encoder/transmitter 128 enables the silent awakening feature associated with the present invention. A back-up audible alarm signal is provided by either an audible tone 127 or radio 126. Other sound producing equipment, such as compact disc audio players, cassette players, and similar equipment may also be provided to supply the back-up audible alarm signal, such substitution of audible alarm sources being known to those skilled in the art. The encoder/transmitter 128 is coupled to antenna 129 for transmission of a silent awakening alarm signal thereover.

Receiving/vibrating unit 140-1 is designed to receive the transmission of the silent awakening alarm signal transmitted from the corresponding alarm circuit 120-1 and convert the alarm signal into a vibration which will awaken the user whose body is in contact with the device. The present invention illustrated in FIG. 1 and having n alarm circuits 120 supports n receiving/vibrating units 140 capable of providing silent awakening service for n users from one base unit alarm clock circuit 100. The receiving/vibrating unit 140-1 is comprised of an antenna 142 and receiver 144 to receive the transmitted alarm signal, a decoder 146 to decrypt a received signal and thereby authenticate the validity of a received alarm signal, and a vibrating mechanism 148 for awakening a user when an alarm signal is received.

Figure 3:
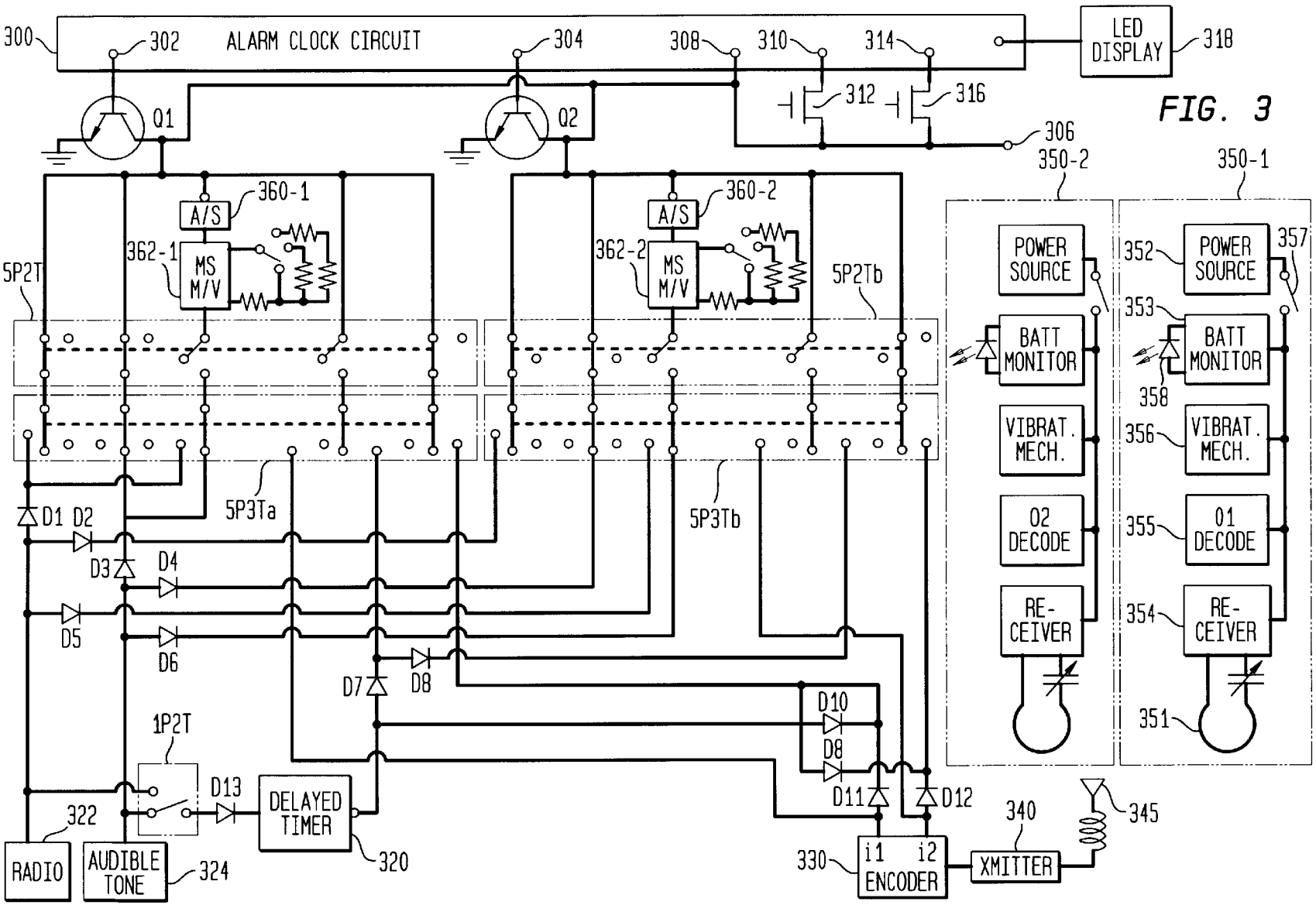
FIG. 3 is a simplified schematic of one embodiment of the present invention.

FIG. 3 is a simplified schematic of a preferred embodiment of the present invention. The timekeeping and alarm functions associated with the instant embodiment of the present invention are performed by conventional and commercially available multi-function digital clock integrated circuits operable to provide data used to display current time and alarm setting data, snooze function incorporated within alarm functions, alarm activation/deactivation inputs, and capable of at least two independent alarm functions. One such alarm clock integrated circuit (IC) 300 is the LC85632 digital alarm clock IC manufactured by Sanyo Electric Co., Ltd. with Semiconductor Business Headquarters in Tokyo, Japan. The instant embodiment of the present invention as illustrated in FIG. 3 incorporates an IC 300 providing two independent alarm output terminals; alarm output terminal #1 302 and alarm output terminal #2 304. DC power is supplied to the IC 300 via power supply terminal VDC 306 to IC 300 power pin 308. A snooze feature is a common component of alarm clock circuits. Snooze function pin 310 is coupled via a snooze switch 312 to VDC 306. Temporary closure of snooze switch 312 deactivates any current alarm signal at alarm output terminals 302,304 for a preset time period. An alarm deactivation pin 314 is coupled via an alarm deactivating switch 316 to VDC 306. Temporary closure of alarm deactivating switch 316 disables any current alarm signal at alarm output terminals 302,304. Time and alarm information are provided to an LED display 318 through IC 300 display terminal pin 314.

When the present time stored in the alarm clock circuit matches a user defined alarm time, the IC 300 provides an alarm signal at the appropriate alarm output terminal 302 or 304. An alarm signal is generated and available at alarm output terminal #1 302 when a user defined alarm time for alarm #1 is reached. Similarly, an alarm signal is present at alarm output terminal #2 304 when a user defined alarm time for alarm #2 is reached. Alarm driver Q1 and Q2 are coupled to alarm output terminals 302,304 respectively to amplify alarm signal #1 and alarm signal #2 respectively for the purpose of activating downstream alarm components. In the instant embodiment of the present invention, the alarm drivers are configured as common emitter transistor amplifiers, although other amplifier devices and configurations would also be apparent to those skilled in the art.

Figure 4:
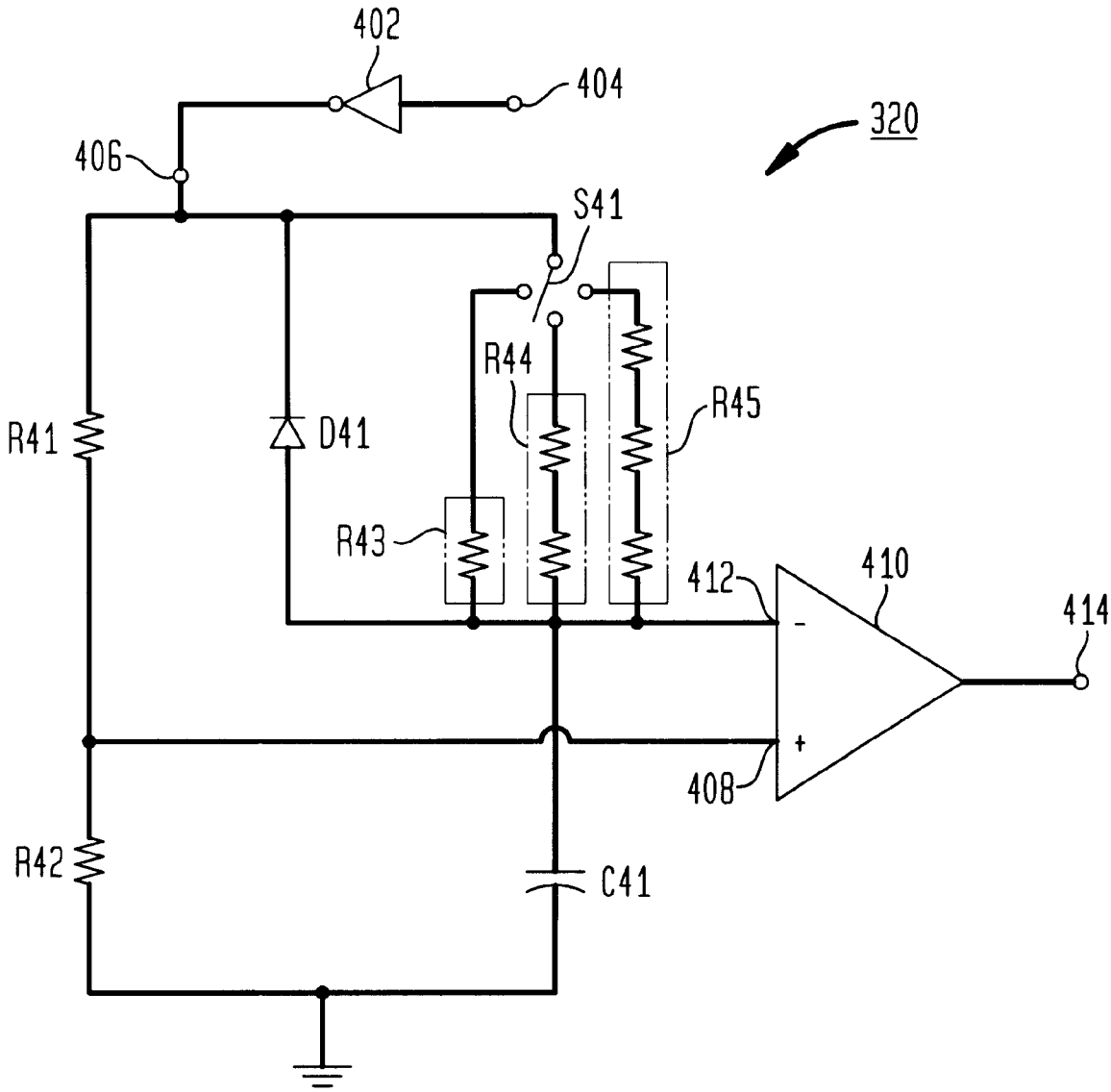
FIG. 4 is a schematic diagram of one embodiment of a delayed timer circuit utilized within a back-up audible alarm and in accordance with the present invention.

Two quintuple pole triple throw (5P3T) switches are provided as functional switching devices to allow the user to choose mode of wake-up between a radio alarm, an audible buzzer alarm, and a remote controlled (r.c.) vibrating alarm. Switch 5P3Tb is associated with alarm signal #1 and 5P3Tb is associated with alarm signal #2. Diodes $D_1$ through $D_{13}$ are incorporated into the connecting circuitry to assure that alarm signals generated by Q1 and Q2 arrive only at the intended circuitry. When a 5P3T switch is directed towards the radio setting and the present time matches a stored alarm time, an alarm driver (Q1 or Q2) for the respective alarm channel energizes the radio. When a 5P3T switch is set at the audible buzzer setting and the present time matches a stored alarm time, an alarm driver (Q1 or Q2) for the respective alarm channel energizes the audible buzzer alarm. When a 5P3T switch is placed at the r.c. vibrating alarm setting and the present time matches an alarm time, an alarm driver (Q1 or Q2) for the respective alarm channel energizes the delayed timer circuit 320. A detailed drawing of one embodiment of a delayed timer circuit is shown in FIG. 4, although other delay devices may also be utilized in conjunction with the present invention as would be known to those skilled in the art.

The delayed timer circuit 320 is used to activate an audible back-up alarm after a preset time period has elapsed since the original alarm signal was activated. An inverting buffer circuit 402 is incorporated into the connecting circuitry to invert the negative voltage alarm signal applied to the delayed timer input terminal 404 by alarm driver Q1 or Q2. A negative voltage alarm signal at the delayed timer input terminal 404 will therefore produce a positive voltage at the inverting buffer circuit output terminal 406. The non-inverting input 408 of the delayed timer comparator 410 is provided with a reference voltage determined by the value of two resistors comprising a voltage divider, R41 and R42. Once a positive voltage is produced at the inverting buffer circuit output terminal 406, capacitor C41 charges through a user selected resistive network. As the charge across capacitor C41 increases, the corresponding voltage at the delayed timer comparator 410 inverting input 412 increases. The amount of charge time required for the inverting input voltage 412 to exceed the non-inverting input 408 voltage determines the time of delay associated with the circuit. A time delay selector switch S41 allows the user to select from various resistive networks, R43, R44, and R45, to vary the delay time by increasing or decreasing resistance through which the capacitor C41 charges.

When the voltage at the comparator's inverting input 412 exceeds the voltage at the comparator's non-inverting input 408, the comparator 410 produces a negative DC voltage at its output terminal 414. This negative voltage activates either a radio 322 or an audible buzzer alarm 324, depending on the setting of a single pole double throw switch 1P2T. When the positive voltage is removed from the inverting buffer circuit output terminal 406, capacitor C41 discharges though the diode D41. As C41 discharges, the voltage at the comparator's inverting input 412 decreases below the voltage at the comparator's non-inverting input 408 and the comparator 410 ceases to produce the negative DC voltage required to power the audible alarms.

When either of the alarm driving units Q1 or Q2 triggers the delayed timer circuit 320, it also concurrently triggers an encoder circuit 330 through one of two input terminals, il or i2. Once triggered, the encoder circuit 330 emits an encrypted message in binary format (1's and 0's) to a transmitting circuit 340. Various encoding circuits are commercially available, however, a microcontroller may also be programmed to function as an encoding circuit, as would be known to those skilled in the art. One commercially available encoder suitable for use as the encoder incorporated within the present invention is the HCS200 KEELOQ® Code Hopping Encoder IC manufactured by Microchip Technology Inc. of Tempe, Ariz. The encoder 330 repeats emission of the same coded signal until the alarm signal produced by alarm drivers Q1 or Q2 ceases. Repeating transmission of the same encrypted signal increases the probability that at least one of the transmissions is successfully received and decoded.

The encoded emission is conveyed to a coupled transmitter 340. Fully integrated transmitting circuits for non-registered, low-power devices, such as used within the instant embodiment of the present invention, are commercially available. One such commercially available transmitter suitable for use as the transmitter incorporated within the present invention is the HX1002-1 Hybrid Transmitter IC manufactured by RF Monolithics Inc. of Dallas, Tex. The HX1002-1 IC is a miniature transmitter module that generates on-off keyed (OOK) modulation from an external digital encoder. The carrier frequency is quartz, surface-acoustic-wave (SAW) stabilized, and output harmonics are suppressed by a SAW filter. The transmitter circuit 340 of the instant embodiment of the present invention filters, amplifies, and modulates the encrypted message input. The modulated output waveform is then radiated via an antenna 345 coupled to the transmitter circuit 340 output. The instant embodiment of the present invention utilizes a coiled loaded whip antenna 345 to radiate the alarm signal, although those skilled in the art would know that a variety of other antenna types and designs may also be utilized in conjunction with the present invention. One such alternative embodiment utilizes a spiral antenna configuration for the transmitting antenna 345. A spiral antenna is similar to a coil loaded whip antenna except that the coil has been flattened so that it may be incorporated within a printed circuit board. In still other embodiments of the present invention, the selected transmitting antenna 345 is either a patch or chip antenna. A patch antenna is fabricated utilizing a planar section of metal printed on one side of a printed circuit board with a grounding plane affixed to the opposite side of the printed circuit board. One edge of the patch is grounded through the printed circuit board to the grounding plane. A chip antenna is a surface mounted device, and it behaves similarly to a whip antenna. Chip antennas are typically utilized for antenna design when available space is a concern since chip antennas are typically much smaller than an analogous whip antenna.

At least one receiving unit 350 of the present invention is held against the user's body by a band, strap, clip or by other means for attaching or affixing a device to a person or his/her clothing. The instant embodiment of the present invention, in accordance with FIG. 3, has two receiving units, each operable to independently awaken one user, receiving unit #1 350-1 and receiving unit #2 350-2. The subsequent description describes the configuration and operation of receiving unit #1 350-1, however, the description is equally applicable for the configuration and operation of matching receiving unit #2 350-2.

An antenna 351 is incorporated within each receiving unit 350 to receive a wake-up signal from a respective wake-up channel. The wake-up signal from one transmitted channel is differentiated from the wake-up signal from subsequent channels by (i) encryption of the wake-up signal at the encoder, or (ii) allocation of separate frequencies for each individual wake-up signal, or (iii) both encryption of the wake-up signal at the encoder and allocation of separate frequencies for each individual wake-up signal. Many choices for the receiving antenna 351 utilized in conjunction with the present invention are available, as would be apparent to those skilled in the art. For instance, the instant embodiment of the present invention utilizes a loop as the receiving antenna 351.

Each receiving unit 350 is comprised of a conventional power source 352, such as a battery, a battery monitor circuit 353, a receiver circuit 354, decoding circuitry 355, and a vibrating mechanism 356. The user energizes the components which comprise each receiving unit 350 from the power source 352 via a receiver on/off switch 357. The conventional battery monitor circuit 353 energizes a light emitting diode (LED) 358 which alerts the user that the battery power supply 352 state of charge (voltage) is below an acceptable threshold level. Such battery monitor circuits are well known in the art.

The receiver circuitry 354 filters, amplifies, and detects the transmitted RF alarm signal from a corresponding alarm channel. Fully integrated receiving circuits for low-power devices, such as the instant embodiment of the present invention, are commercially available. One such commercially available IC suitable for use as the receiver incorporated within the present invention is the RX1100 receiver IC manufactured by RF Monolithics Inc. of Dallas, Tex. The RX1100 receiver IC is operable to receive the transmissions supplied by the aforementioned HX1002-1 transmitter IC.

The output of the receiver circuit 354 is coupled to the input of the decoder circuit 355. After filtering, amplifying, and detecting the RF alarm signal, the receiving circuit 354 conveys the encrypted message in its original binary format to the decoder circuit. Decoder circuits are commercially available, however alternate embodiments of the present invention may also use a microcontroller circuit programmed to decrypt, as is well known to those skilled in the art. One example of a commercially available decoder is the HCS512 KEELOQ® Code Hopping Decoder IC manufactured by Microchip Technology Inc. of Tempe, Ariz.

Many decoders, such as the aforementioned HCS512 KEELOQ® Code Hopping Decoder IC, utilize a scheme wherein a decoder circuit decodes a message created by a particular encoder circuit only after the "child" decoder "learns" and recognizes the identity of its "parent" encoder. During the learning process, a code which identifies the parent encoder is stored in the child decoder's memory. This identification code is a component of each transmission by the parent encoder. The identification code allows the child decoder to differentiate signals sent by its parent encoder from signals sent from other encoders of the same family.

More than one child decoder circuit may learn to recognize a particular parent encoder. The decoder has two output terminals—o1 and o2. Upon receiving a message originally encrypted by the parent encoder, one of the output terminals of each child decoder emits a voltage for a preset time period. If the decoder receives the encoder's continuously repeating message, the decoder's output terminal produces a voltage for a preset quantity of time after the last transmission was received.

The input terminal of the parent encoder originally activated by the alarm clock circuit determines which output terminal of the child decoder circuit is eventually activated. For example, alarm #1 activates the input terminal i1 of the encoder circuit, leading to the activation of the o1 output terminal of any child decoders that have learned to recognize the parent encoder. Similarly, alarm #2 activates the i2 input terminal of the encoder circuit, leading to the activation of the o2 output terminal of any child decoders that have learned to recognize the parent encoder.

The alarm clock circuit 300 of the instant embodiment of the present invention is operable to independently control two vibrating alarms, one vibrating alarm in receiving unit #1 350-1, and a second vibrating alarm in receiving unit #2 350-2. In order to facilitate two separate vibrating alarms in two separate receiving units, the output terminals of each child decoder are routed to different destinations. Activating alarm #1 of the alarm clock circuit 300 (and consequently alarm driver Q1) makes available a generated alarm signal at the ol output terminal of each associated child decoder. Therefore, output terminal ol of the child decoder in receiving unit #1 350-1 is coupled with its respective vibrating mechanism 356. Output terminal ol of the child decoder in receiving unit #2 350-2 is left unconnected. In a similar manner, activating alarm #2 of the alarm clock circuit 300 (and consequently alarm driver Q2) makes available a generated alarm signal at the o2 output terminal of each associated child decoder. Therefore, output terminal o2 of the child decoder in receiving unit #2 350-2 is coupled with its respective vibrating mechanism 356. Output terminal o2 of the child decoder in receiving unit #1 350-1 is left unconnected. Such an arrangement allows a single alarm clock circuit 300 to independently control two vibrating alarm receiving units 350-1 and 350-2 attached to two different users.

Vibrating mechanisms are well known to those skilled in the art. In one embodiment of the present invention, an electromagnetic motor drives the vibrating mechanism 356. When triggered, the motor rotates a mass via a resilient connecting element. This rotation causes the receiving case to vibrate and alert the user. In an alternate embodiment of the present invention, the vibrating mechanism 356 is comprised of a piezo-electric motor utilized to drive an eccentric mass rotably mounted on a spindle. Rotation of this mass would similarly cause the receiving case to vibrate and alert the user. There are yet other alternative embodiments of the present invention in which vibrations are created via the use of a hammering member, bar, or lever that strikes a plate.

Figure 5:
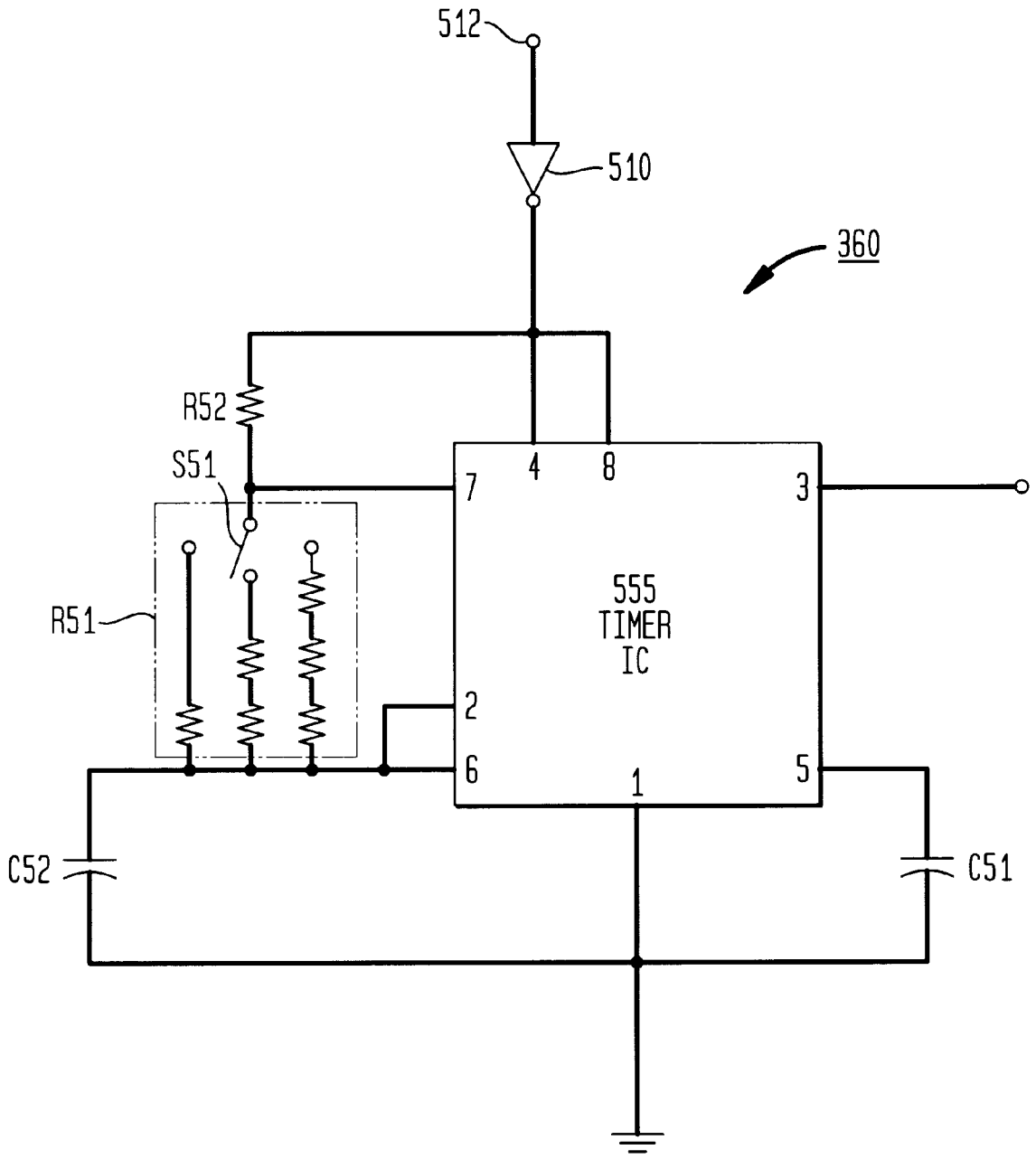
FIG. 5 is a schematic diagram of one embodiment of an astable multivibrator circuit utilized within the cyclical alarm interrupt function in accordance with the present invention.

Two quintuple pole double throw (5P2T) switches are provided as device switching units to allow the user to activate a cyclical alarm interrupt (CAI) option for alarm #1 and alarm #2. Switch 5P2Tb is associated with alarm signal #1 and 5P2Tb is associated with alarm signal #2. When a 5P2T switch is placed in its inactive position, as illustrated in FIG. 3, the respective alarm channel functions as previously described. However, when a 5P2T switch is placed in its active (alternate) position, alarm signals generated by the alarm drivers, Q1 and Q2, are directed through respective switch 5P2Ta and 5P2Tb to respective coupled oscillating circuits. In the instant embodiment of the present invention as illustrated in FIG. 3, the oscillating circuit is comprised of an astable multivibrator 360 with a rectangular wave output as illustrated in FIG. 5. Astable multivibrator 360-1 is associated with alarm channel #1 and astable multivibrator 360-2 is associated with alarm channel #2.

The purpose of the astable multivibrator 360 is to activate a downstream coupled monostable multivibrator 362 at a programmable frequency. Many alternative astable multivibrator types and designs are available for use in conjunction with the present invention, however, the astable multivibrator 360 which is associated with the instant embodiment of the present invention as illustrated in FIG. 5 utilizes a 555 timer IC. One company manufacturing the 555 timer is National Semiconductor Inc. in Santa Clara, Calif. which produces the 8 pin LM555 timer, although other semiconductor manufacturers are also producing the 555 timer.

The 555 timer IC is powered by grounding pin 1 and applying a positive DC voltage to pin 8. An inverting buffer circuit 510 is incorporated at the input terminal 512 of the astable multivibrator 360 to invert the negative DC voltage alarm signal generated by the respective alarm driver Q1 or Q2. The output of the inverting buffer circuit 510 is coupled to 555 timer IC pin 8. Pin 4 is coupled to the potential at pin 8 and pin 5 is grounded through capacitor C51 to prevent false triggering of the circuit. The potential available at pins 2, 6, and 7 determine the parameters of the generated waveform produced at the output on pin 3.

When the CAI circuit is bypassed by switch 5P2T, or when the CAI circuit is selected through switch 5P2T but an alarm signal is not being generated by the respective alarm driver Q1 or Q2, output potential at pin 3 of the astable multivibrator remains at a low voltage state. When a positive voltage is applied to input terminal 8, the output voltage at pin 3 switches to a high voltage state and oscillation begins. The quantity of time (in seconds) that the output voltage at pin 3 is at its high voltage value ($T_H$) during the duty cycle is determined by the respective value of the capacitor C52 (in microfarads) and resistors R51 and R52 (in megaohms) according to the equation $$T_H=0.693*(R51+R52)*C$$

and the quantity of time (in seconds) that the output voltage at pin 3 is at its low voltage value ($T_L$) during the duty cycle is determined by the respective value of the capacitor C52 (in microfarads) and resistor R51 (in megaohms) according to the equation $$T_L=0.693*R51*C.$$

The user may adjust the frequency of oscillation and the duty cycle for the astable multivibrator 360 by varying the value of resistor R51 through switch S51. Each time the output terminal of the astable multivibrator circuit at pin 3 switches to a high voltage value, an electrically coupled conventional monostable multivibrator circuit 362 is triggered. The output terminal of the monostable multivibrator circuit normally remains at a high voltage value. Once triggered, the output terminal of the monostable multivibrator circuit switches to a low voltage value for a time determined by the values of an external resistor (in megaohms) and capacitor (in microfarads) according to the equation $T_L=R*C$. The user can increase this time using a switch on the clock that effectively adds resistance to R. Other alternative methods for implementing a monostable multivibrator circuit are also well known and it would be apparent to those skilled in the art that such alternative monostable multivibrator circuits would be compatible for use within the present invention.

The aforementioned astable multivibrator 360 and monostable multivibrator 362 work in concert to switch the appropriate alarm channel on and off at a programmable duty cycle when switch 5P2T is positioned to select the CAI function. For example, alarm channel #1 is activated when the output terminal of the monostable multivibrator 362-1 is at a low voltage value. Therefore, the quantity of time for which the alarm remains activated during the alarm cycle is determined by the time constant associated with the monostable multivibrator 362-1. The alarms are inactive when the output of the monostable multivibrator 362-1 is at a high voltage value (its default setting). Therefore, the quantity of time for which the alarm remains deactivated during the alarm cycle is determined by the time constant of the astable multivibrator 360-1 (as determined by the selected setting of switch S51).

With the 5P2T switch in its active position (CAI selected) and the 5P3T alarm setting switch at the radio setting, the radio alarm will turn on and off at a preset duty cycle beginning at the preset alarm time. With the 5P2T switch in its active position (CAI selected) and the 5P3T alarm setting switch at the audible buzzer setting, the audible buzzer will turn on and off at a preset duty cycle beginning at the preset alarm time. With the 5P2T switch in its active position and the 5P3T alarm setting switch at the r.c. vibrating alarm setting, the clock will transmit encrypted alarm signals at a preset duty cycle beginning at the preset alarm time. When CAI is selected through switch 5P2T, the delayed timer circuit 320 still receives a constant signal from its respective alarm driver Q1 or Q2 (when the respective alarm driver is conducting during an alarm condition) through provided bypass lines. After a preset time, the delayed timer 320 produces a negative voltage for the purpose of activating either the radio alarm or the audible buzzer alarm. As previously described, the purpose of the delayed alarm signal is to alert users with normal hearing in the event that the receiving unit should fail to receive and decrypt the transmitted alarm signal for any reason.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention and is not intended to illustrate all possible forms thereof. It is also understood that the words used are words of description, rather than limitation, and that details of the structure may be varied substantially without departing from the spirit of the invention and the exclusive use of all modifications which come within the scope of the appended claim is reserved.

What is claimed is:

1. An claim clock for silently awakening a user among a plurality of users comprising:

an alarm time setting means for setting a user-defined alarm time, one alarm time for each of said plurality of users; said alarm time corresponding to a user-defined time-of-day, an alarm time detection means for producing an initial alarm signal when said alarm time detection means detects a coincidence of the present time with said user-defined alarm time set by said alarm time setting means;

an encoder for producing an encrypted alarm signal when presented with said initial alarm signal wherein said encrypted signal identifies said user; and a transmitter for transmitting said encrypted alarm signal.

2. The alarm clock in accordance with claim 1 further comprising an audible back-up alarm.

3. The alarm clock in accordance with claim 2 wherein said audible back-up alarm is provided by a radio receiving device incorporated within said alarm clock.

4. The alarm clock in accordance with claim 2 wherein said audible back-up alarm is provided by an audible tone producing device incorporated within said alarm clock.

5. The alarm clock in accordance with claim 2 wherein said audible back-up alarm is activated a time delay period after said encrypted alarm signal is transmitted.

6. The alarm clock in accordance with claim 5 wherein the quantity of time associated with said time delay period is definable by said user.

7. The alarm clock in accordance with claim 1 further comprising a means for producing a cyclical alarm interrupt function, said means for producing said cyclical alarm interrupt function operable to accept said initial alarm signal as an input and to produce a modified alarm signal as an output, said modified alarm signal characterized as repetitively alternating between a first value state and a second value state, said first value state resulting in a wake-up alarm for said user and said second value state resulting in a cessation of said wake-up alarm for said user.

8. The alarm clock in accordance with claim 7 wherein said cyclical alarm interrupt function has a user-selectable duty cycle for the relationship of time for which said modified alarm signal is at said first value state compared to said second value state.

9. The alarm clock in accordance with claim 8 wherein said cyclical alarm interrupt function is performed by a serial combination of an astable multivibrator followed by a monostable multivibrator.

10. The alarm clock in accordance with claim 1 further comprising a receiving unit, said receiving unit including:

a receiving circuit for receiving said encrypted alarm signal transmitted from said transmitter;

a decoder for decrypting and authenticating said encrypted alarm signal and producing a wake-up signal; and a vibrating mechanism for producing a mechanical vibration upon receiving said wake-up signal, said mechanical vibration utilized to awaken said user when said vibrating mechanism is in contact with said user.

11. The alarm clock in accordance with claim 1 wherein said alarm time setting means is operable for setting a second user-defined alarm time, and wherein said alarm time detection means is operable to produce a second initial alarm signal when said alarm time detection means detects a coincidence of the present time with said second user-defined alarm time set by said alarm time setting means, and wherein said encoder is operable to produce a second encrypted alarm signal when presented with said second initial alarm signal, and wherein said transmitter is operable to transmit said second encrypted alarm signal.

12. An alarm clock for silently awakening a user among a plurality of users comprising:

an alarm time setting means operable to set a user-defined alarm time one alarm time for each of said plurality of users; said alarm time corresponding to a user-defined time-of-day, an alarm time detection means operable to produce an initial alarm signal when said alarm time detection means detects a coincidence of the present time with said user-defined alarm time set by said alarm time setting means;

an encoder operable to produce an encrypted alarm signal when said initial alarm signal is available as an input to said encoder wherein said encrypted signal identifies said user;

a transmitter operable to transmit said encrypted alarm signal;

a receiving circuit operable to receive said encrypted alarm signal transmitted from said transmitter;

a decoder operable to decrypt and authenticate said encrypted alarm signal and produce a corresponding wake-up signal; and a vibrating mechanism operable to produce a mechanical vibration upon receiving said wake-up signal, said mechanical vibration utilized to awaken said user when said vibrating mechanism is in contact with said user.

13. The alarm clock in accordance with claim 12 further comprising a means for producing a cyclical alarm interrupt function, said means for producing said cyclical alarm interrupt function operable to accept said initial alarm signal as an input and produce a modified alarm signal as an output, said modified alarm signal characterized as repetitively alternating between a first value state and a second value state, said first value state resulting in a wake-up alarm for said user and said second value state resulting in a temporary abatement of said wake-up alarm for said user.

14. The alarm clock in accordance with claim 13 wherein said cyclical alarm interrupt function is performed by a serial combination of an astable multivibrator followed by a monostable multivibrator.

15. The alarm clock in accordance with claim 14 further comprising an audible back-up alarm.

16. The alarm clock in accordance with claim 15 wherein said audible back-up alarm is provided by a radio receiving device incorporated within said alarm clock.

17. The alarm clock in accordance with claim 15 wherein said audible back-up alarm is provided by an audible tone producing device incorporated within said alarm clock.

18. The alarm clock in accordance with claim 15 wherein said audible back-up alarm is activated a time delay period after said encrypted alarm signal is transmitted.

19. The alarm clock in accordance with claim 18 wherein the quantity of time associated with said time delay period is definable by said user.

20. An alarm clock for silently awakening a user comprising:

a timekeeping circuit operable to provide a time display output and an alarm signal output;

a time display panel coupled to receive said time display output from said timekeeping circuit;

a functional switching unit coupled to receive an alarm signal from said alarm signal output of said timekeeping circuit;

a delayed timer coupled to receive said alarm signal from said functional switching unit when said functional switching unit is selected to provide a back-up alarm to said user;

a cyclical alarm interrupt circuit to intermittently prevent said alarm signal presence at the output of said cyclical alarm interrupt circuit when said functional switching unit is selected to provide a cyclical alarm interrupt option;

a device switching unit coupled to receive said alarm signal from the output of said delayed timer and the output of said cyclical alarm interrupt circuit;

an encoder having an encoder input and an encoder output, said encoder operable to produce an encrypted alarm signal at said encoder output when said alarm signal is present at said encoder input and said device switching unit is selected to provide a silent awakening alarm for said user;

a transmitting circuit having a transmitter input, said transmitter input coupled to said encoder output, said transmitter operable to transmit said encrypted alarm signal; and an audible back-up alarm operable to provide an acoustic alarm signal to awaken a user when said device switching unit is selected to provide a back-up awakening feature, said acoustic alarm delayed in time from the initial occurrence of said alarm signal.

* * * * *